US008424436B2

(12) United States Patent
Weber

(10) Patent No.: US 8,424,436 B2
(45) Date of Patent: Apr. 23, 2013

(54) CUTTING KNIFE

(75) Inventor: Guenther Weber, Gross Nemerow (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 524 days.

(21) Appl. No.: 12/733,385

(22) PCT Filed: Aug. 27, 2008

(86) PCT No.: PCT/EP2008/007021

§ 371 (c)(1),
(2), (4) Date: Feb. 26, 2010

(87) PCT Pub. No.: WO2009/027080

PCT Pub. Date: Mar. 5, 2009

(65) Prior Publication Data

US 2010/0162868 A1 Jul. 1, 2010

(30) Foreign Application Priority Data

Aug. 27, 2007 (DE) ..... 10 2007 040 350

(51) Int. Cl.
*B26D 1/12* (2006.01)

(52) U.S. Cl.
USPC ..... 83/676; 83/932

(58) Field of Classification Search ..... 83/676, 83/663, 932, 342, 666, 672, 341, 596, 340; 30/347, 310, 109, 357; 241/282.1
See application file for complete search history.

(56) References Cited

U.S. PATENT DOCUMENTS

| | | | | |
|---|---|---|---|---|
| 5,482,166 | A * | 1/1996 | Brown | 209/580 |
| 7,856,913 | B2 * | 12/2010 | Matzunsky et al. | 83/676 |
| 2004/0035276 | A1 * | 2/2004 | Weber | 83/672 |
| 2005/0262980 | A1 | 12/2005 | Matzunsky et al. | |

FOREIGN PATENT DOCUMENTS

| | | |
|---|---|---|
| EP | 0 709 170 | 5/1996 |
| EP | 1 598 159 | 11/2005 |

OTHER PUBLICATIONS

German Search Report dated May 21, 2008 along with an English translation of same.
International Search Report, Date:Jan. 13, 2009.

* cited by examiner

*Primary Examiner* — Ghassem Alie
(74) *Attorney, Agent, or Firm* — Collard & Roe, P.C.

(57) ABSTRACT

A cutting blade for machines for slicing food products, particularly for high-speed slicers, has a sickle-shaped blade rotating about a rotation axis during the slicing operation and has a cutting edge that deviates from a circular shape at the radially outer circumference thereof and revolves about the rotation axis, particularly in the manner of a spiral. The edge is positioned in a cutting plane extending perpendicular to the rotation axis, and the cutting edge forms the radially outer end of a cutting surface, which forms part of the blade back side facing away from a product to be sliced during the slicing operation and includes a blade angle together with the cutting plane. The size of the blade angle varies in the circumferential direction.

14 Claims, 3 Drawing Sheets

CUTTING KNIFE

CROSS REFERENCE TO RELATED APPLICATIONS

Figure 1:
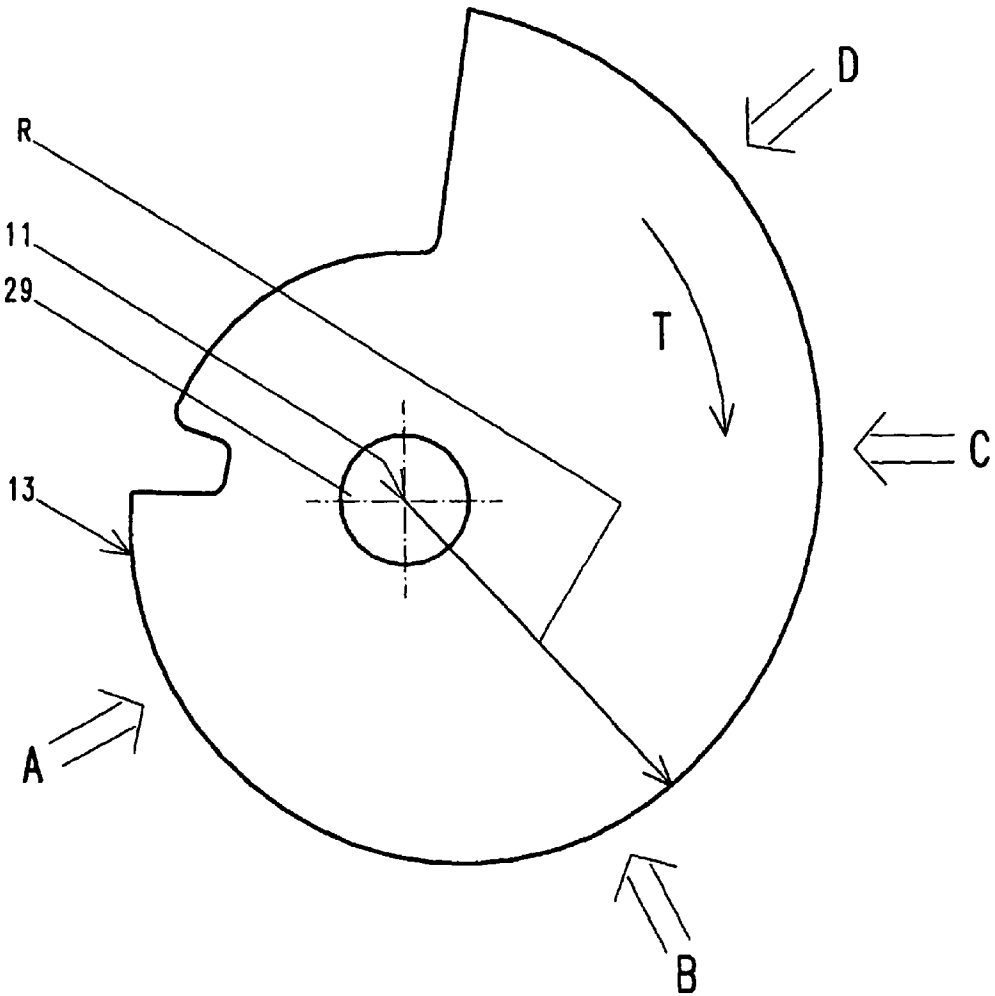

This application is the National Stage of PCT/EP2008/007021 filed on Aug. 27, 2008, which claims priority under 35 U.S.C. §119 of German Application No. 10 2007 040 350.1 filed on Aug. 27, 2007. The international application under PCT article 21(2) was not published in English.

The invention relates to a cutting knife for machines for the cutting up of food products, in particular for high-speed slicers, wherein the cutting knife is a scythe-like knife which rotates about an axis of rotation during the cutting operation and which has a cutting edge at its radially outer periphery which differs from a circular shape, which in particular revolves about the axis of rotation in the manner of a spiral and which is disposed in a cutting plane extending perpendicular to the axis of rotation.

Cutting knives of this type are generally known. The knives used for use at slicers and in particular at high-speed slicers usually have a shape which is in the widest sense shell-like or bowl-like, i.e. on the side of the knives facing a product to be cut up during the cutting operation, the knife body is set back with respect to the cutting plane defined by the cutting edge of the knife. It is hereby achieved that compressions of the product to be cut up are largely avoided. This shell shape or bowl shape of the knife at one side therefore practically does not influence the product itself during the cutting operation; only the just cut off product slice has to avoid the cutting knife, which is, however, not problematic due to its easier deformability.

The magnitude of the so-called blade angle is critical for practice. The blade angle is that angle which a planar surface, which will also be called a blade surface in the following, which is located at the radially outer periphery of the cutting knife and whose radially outwardly disposed end is formed by the cutting edge, includes with the cutting plane extending perpendicular to the axis of rotation of the knife. The magnitude of the blade angle, that is the steepness of the blade surface, determines the influencing of the product to be cut up, on the one hand, and the manner of the placing of the respectively cut off product slice by the cutting knife, on the other hand. It must be taken into account in this respect that particularly scythe-type knives are used in conjunction with modern high-speed slicers for particularly high cutting speeds. These cutting speeds amount, for example, to up to 2,000 cuts a minute, i.e. high-speed slicers equipped with scythe-type knives can easily cut off more than 30 product slices a second.

In practice, the magnitude of the blade angle is selected in dependence on the specific product and application circumstances. The blade angle, which is constant along the cutting edge, in this respect always represents a compromise with respect to the respective products to be cut up. Too large a blade angle, i.e. too steep a blade surface, must be avoided where possible since too great a pressure is hereby exerted onto the product and the product could thus no longer be exposed to acceptable compressions, A small blade angle, in contrast, i.e. a relatively flat-set blade surface, produces gentle, soft cuts which do not compress the product unnecessarily. However, with such a flat-set cutting knife, the placing behavior which is desired in most cases with respect to the respective cut off product slices cannot be achieved. The product slices can in particular not be "slid off" in the actually desired manner using a cutting knife set too flat.

It is the object of the invention to further develop a cutting knife of the initially named kind such that it can satisfy all the specific product and application circumstances, wherein product compressions caused by the cutting knife should in particular be minimized and the product placing effected by the cutting blade should be optimized.

This object is satisfied by the features of claim 1. Provision is in particular made in accordance with the invention that the cutting edge forms the radially outwardly disposed end of a blade surface which forms a part of the rear side of the knife remote from a product to be cut up during the cutting operation and includes a blade angle with the cutting plane, with the magnitude of the blade angle varying in the peripheral direction.

In accordance with the invention, the previously taken approach of a constant blade angle along the cutting edge has been discarded. A direct change in the magnitude of the blade angle in the peripheral direction of the cutting blade rather now takes place in the invention. Such changes naturally do not include any inaccuracies caused by the manufacture which result in deviations from a constant desired angle. It is rather the case in accordance with the invention that the blade angle is directly varied to a relevant degree along the cutting edge, which has noticeable effects, in particular on the degree of the product compressions caused by the cutting knife and on the manner of the product placing effected by the knife.

The invention in particular opens up the possibility of adapting the magnitude of the blade angle to the course of the cutting processing. The blade angle can be selected for each peripheral region of the cutting knife in dependence on the manner in which this peripheral region cooperates with the respective product during the cutting process. Scythe-like knives are used so that a peripheral region thereof dips into the product at which the radius—i.e. the spacing of the cutting edge from the axis of rotation of the knife—is smallest at the start of a cutting procedure. The dipping process of the knife into the product is concluded from a specific angle of rotation onward which corresponds to a specific peripheral region of the cutting edge. The cutting knife moves through the product up to the end of the cutting procedure, with the radius increasing constantly due to the in particular spiral course of the cutting edge with respect to the axis of rotation. These circumstances can be utilized in accordance with the invention to set the magnitude of the cutting angle in dependence on the angle of rotation or on the peripheral region—e.g. with respect to the dipping angle or dipping region—for the optimization of the cutting process overall. Generally, however, there are no limits to the setting possibilities. Depending on the property of the products to be cut up and on the circumstances of the respective application, the cutting knives can be individually optimized on the basis of the variability of the blade angle in accordance with the invention.

Preferred embodiments of the invention are also set forth in the dependent claims, in the description and in the drawing.

It is thus possible in accordance with an embodiment that the blade angle increases constantly.

Provision can, for example, be made that the cutting knife has an intended direction of rotation, with the blade angle increasing against the direction of rotation. In other words, the blade angle increases during the cutting procedure, i.e. the cutting surface on the rear side of the knife bounded radially outwardly by the cutting edge becomes increasingly steeper during the cutting procedure.

With a scythe-like knife such as was described above, i.e. which dips into the product during the cutting procedure with the smallest radius, this thus means that the blade angle in this embodiment increases as the radial spacing of the cutting edge from the axis of rotation increases. This represents a specific embodiment of the general idea, likewise independently claimed here, of selecting the magnitude of the blade angle in dependence on the radial spacing of the cutting edge from the axis of rotation of the cutting knife, that is on the angle of rotation of the knife, i.e. of defining the blade angle as a function of the angle of rotation.

In a preferred embodiment of the invention, the cutting edge has a dipping region with which the cutting knife dips into a product to be cut up on its intended use during the cutting operation, with the blade angle being the smallest in the dipping region.

This embodiment makes use of the recognition that product compressions by the cutting knife are the largest at the moment when the cutting knife dips into the product. Since a comparatively small blade angle and in particular the smallest blade angle formed at the cutting knife is selected for the dipping region of the cutting knife, product compressions by the cutting knife in accordance with the invention are consequently minimized. Starting from the dipping region, the blade angle can then in particular increase constantly. It is hereby achieved that the blade angle has a magnitude or a steepness during the further course of the cutting process and in particular after completion of the dipping phase which provides a desired sliding off of the respective product slice or a faster and better placing of the product slice than would be the case with a continuously flat blade angle.

The change in the blade angle in particular takes place without the formation of steps in the blade surface. The product is hereby disturbed as little as possible during the cutting up.

The blade angle can be constant region-wise This is, however, not compulsory. Provision can also be made that the blade angle changes, in particular increases or reduces, continuously or constantly.

The blade angle profile, i.e. the development of the magnitude of the blade angle along the cutting edge, can generally be designed as desired. The rate at which the blade angle changes can be constant, in dependence on the angle of rotation of the knife, that is on the respective peripheral region of the cutting edge, but can also be of different sizes for different peripheral regions.

Provision can be made in a specific embodiment that the blade angle changes in a range from approximately 20° to 30°. The knife blade can, however, generally also have flatter or steeper regions.

Depending on the specific design of the rear side of the knife, provision can be made that the blade surface has a width which varies in dependence on the magnitude of the blade angle.

The width of the blade surface can, for example, vary in a range from 0.5 mm to 1.5 mm.

As regards the effective length of the cutting edge in the peripheral direction, the cutting edge in particular extends over an angle between 180° and 360°. In a possible embodiment, the length of the cutting edge in the peripheral direction amounts to approximately 270° C.

Provision can furthermore be made In accordance with the invention that a further surface is formed radially within the blade surface and forms a part of the rear side of the knife and includes an angle with the cutting plane which is constant and smaller than the smallest blade angle in the peripheral direction.

The blade surface and the further surface can be directly adjacent to one another. Alternatively, however, it is also possible that at least one transition surface is formed between the blade surface and the further surface.

The manufacture of the blade knife in accordance with the invention should only be looked at here to the extent that provision is preferably made that the blade surface is formed by abrading a correspondingly manufactured precursor product.

Figure 2:
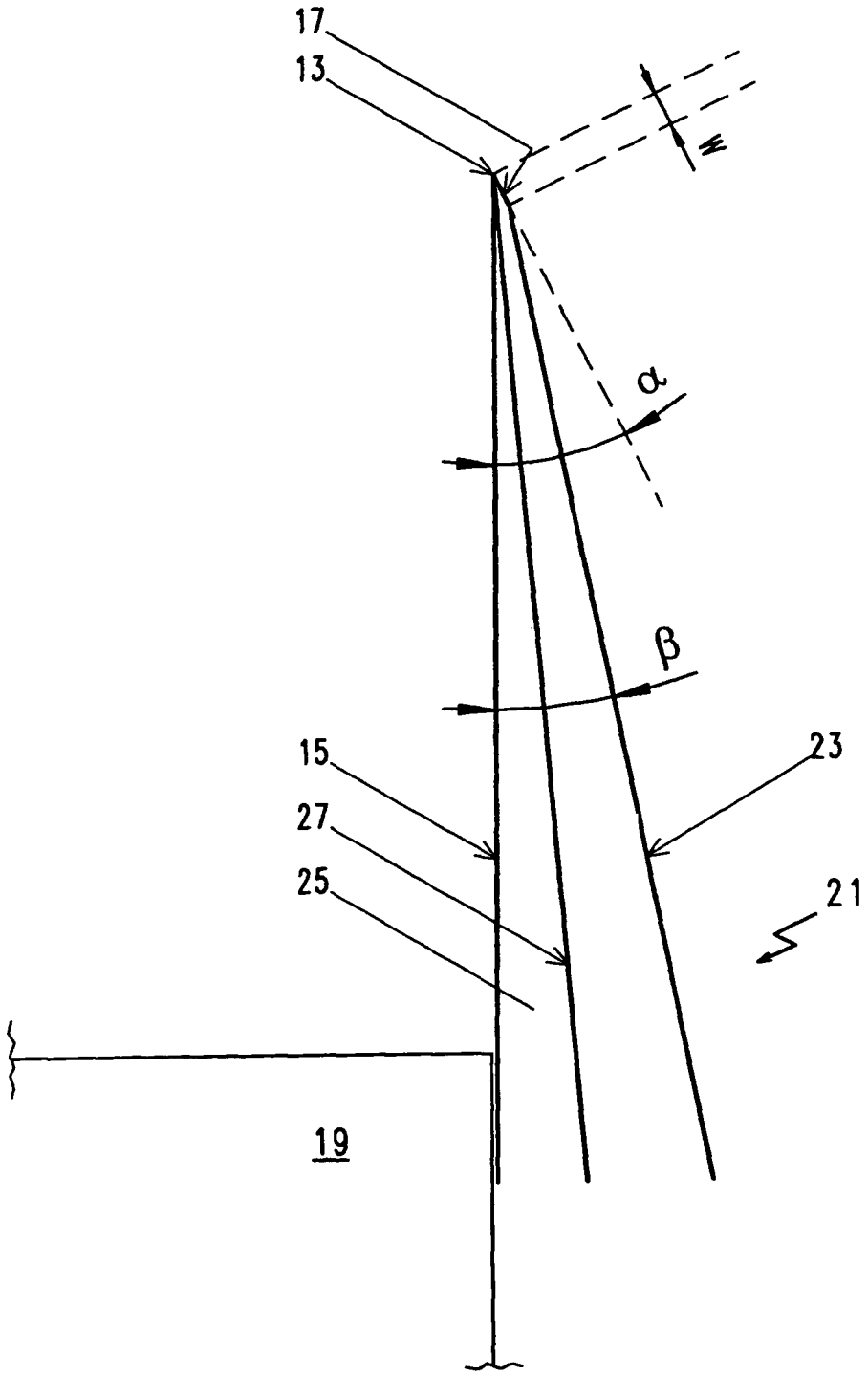

The invention will be described in the following by way of example with reference to the drawing. There are shown:

FIG. 1 a schematic plan view of a cutting knife in accordance with the invention;

FIG. 2 in part, a cross-sectional view of a cutting knife in accordance with the invention; and FIG. 3 a plurality of cross-sectional views of a cutting knife in accordance with the invention at different peripheral regions.

The scythe-like knife in accordance with the invention shown in FIG. 1 includes a cutting edge 13 which revolves spirally about an axis of rotation 11, which extends approximately over an angular range of 270° and which is disposed in a cutting plane extending perpendicular to the axis of rotation 11. The spacing of the cutting edge 13 from the axis of rotation 11, that is the radius R of the cutting knife, increases continuously, and indeed against an axis of rotation T in which the cutting knife rotates about the axis of rotation 11 during the cutting operation.

The scythe-like knife in accordance with the invention is intended for use at a high-speed slicer. These slicers are provided with a so-called cutting head or knife head which has a drive shaft for the cutting knife which defines the axis of rotation 11. The opening 29 in the cutting knife shown in FIG. 1 is formed for the reception of the drive shaft. Further fastening means, such as in particular bores arranged around the opening 29 for the screwing of the cutting knife to the cutting head of the slicer, are not shown for reasons of simplicity.

Such scythe-like knives are characterized in that they—as already mentioned in the introductory part—dip into the product to be cut up with a region A for which the radius R is the smallest. The rotating cutting knife moves through the product during the cutting procedure, with the peripheral regions A, B, C and D of the knife, which are only indicated by way of example here, cooperating with the product after one another. The radius R of the knife is the largest for the peripheral region D.

As can be seen from FIG. 2, the scythe-like knife in accordance with the invention has a shell shape or a bowl shape. Since the inner side 27 of the knife is in this way set back with respect to the cutting plane 15 extending perpendicular to the axis of rotation 11, a free space 25 is present on the side of the knife facing the product 19 to be cut up during the cutting operation. Product compressions are already substantially reduced by this shell shape or bowl shape.

The rear side 21 of the knife is formed radially outwardly by a planar blade surface 17 which is radially outwardly bounded by the cutting edge 13 defining the cutting plane 15. A further planar surface 23 radially inwardly adjoins the blade surface 17. The cross-section of the cutting knife in accordance with the invention adjoining the blade surface 17 can differ from the embodiment shown in FIG. 2 and can generally vary as desired. The specific profile of the knife in this respect is also selected with respect to an inherent stability of the knife which is as good as possible.

The blade surface 17 includes an angle $\alpha$ with the cutting plane 15 which is larger than the angle $\beta$ between the cutting plane 15 and the further surface 23. The blade surface 17 furthermore has a width W.

In accordance with the invention, the blade angle α is not constant along the cutting edge 13. Provision is rather made that the blade angle varies in dependence on the radius R of the cutting edge 13.

Figures 3A, 3B, 3C, 3D:
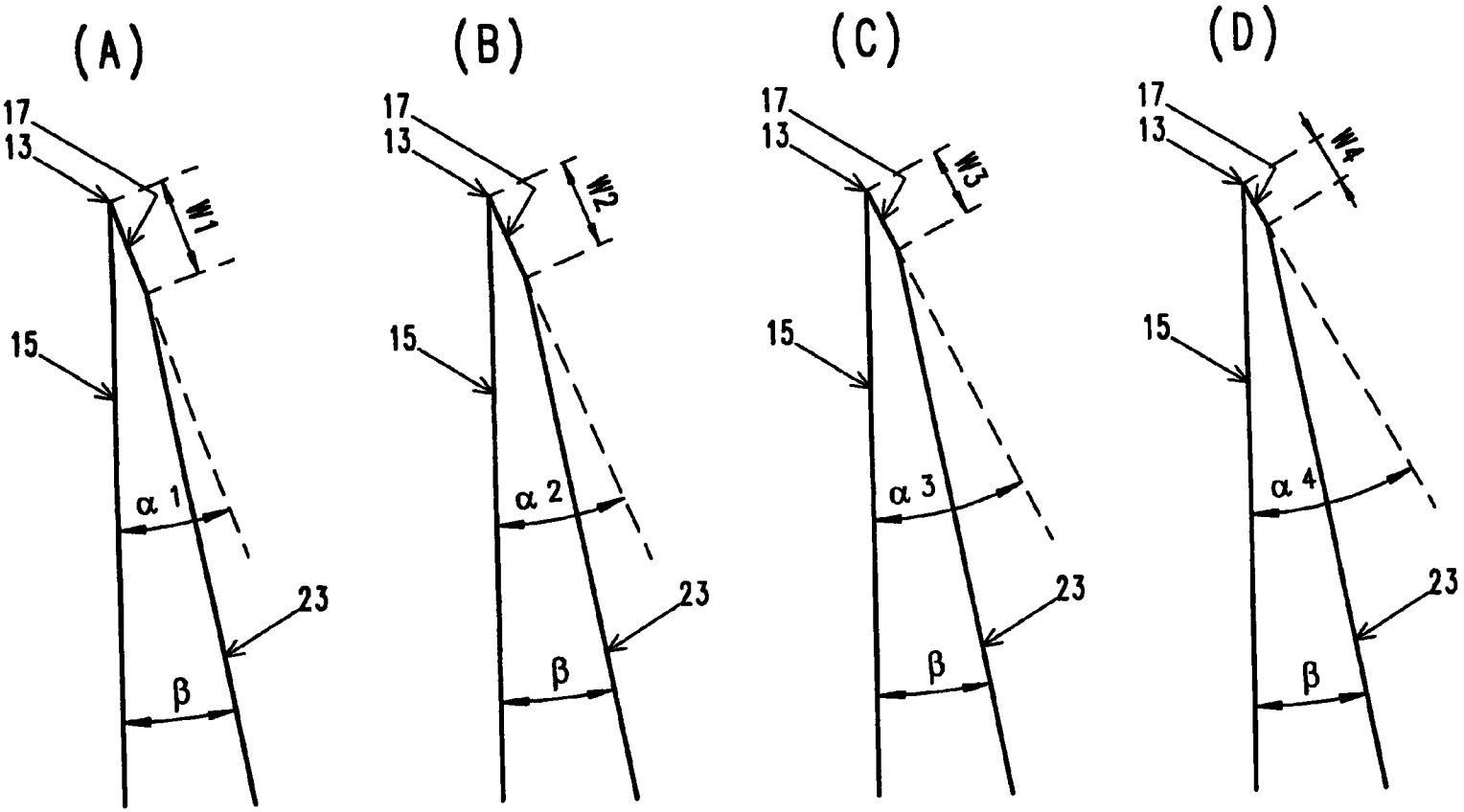

FIG. 3 illustrates a possible embodiment for such a "profile" of the blade angle in the peripheral direction. FIGS. 3*a*-3*d* each show a cross-section of the cutting knife in accordance with FIG. 2 for one of the peripheral regions A-D indicated in FIG. 1.

In accordance with FIG. 3*a*, the blade angle α1 is likewise the smallest in the dipping region A of the cutting knife where the radius is the smallest. Since in this embodiment the angle β between the cutting plane 15 and the further surface 23 adjacent to the blade surface 17 is constant in the peripheral direction and one or more transitions surfaces are not provided at any point in the peripheral direction between the blade surface 17 and the further surface 23, the width W of the blade surface 17 is the largest in the dipping region A.

As the angle of rotation increases (against the direction of rotation T; FIG. 1), the blade surface 17 extends in an increasingly steeper manner, i.e. the blade angle α increases. The width W of the blade surface 17 reduces accordingly.

Some possible values for the blade angle α at the different peripheral regions of the cutting knife are as follows:

Dipping region A: α1=20°
Peripheral region B: α2=23°
Peripheral region C: α3=26°
Peripheral region D: α4=30°

The constant angle β in the peripheral direction, that is along the cutting edge 13, between the cutting plane 15 and the further surface 23 amounts, to 12° in this embodiment.

These values for the angles α and β are purely of an exemplary nature and can vary as desired according to the products to be cut up and according to specific applications, and indeed not only with respect to the absolute magnitudes, but also with respect to the general course of the "angular profiles" in the peripheral direction.

It can be achieved with the embodiment shown here that product compressions on the dipping of the knife into the product are very largely avoided due to the flat blade surface 17 in the dipping region A, with simultaneously a narrower and better product placing being achieved due to the increasing steepness of the blade surface 17 in the peripheral direction than with a continuously flat blade angle.

Reference Numeral List

11 axis of rotation
13 cutting edge
15 cutting plane
17 blade surface
19 product
rear side of the knife
23 further surface
25 free space
27 inner side of the knife
29 opening
α blade angle
β angle between the cutting plane and the further surface
T direction of rotation
R radial spacing
W width of the blade surface
A dipping region
B peripheral region
C peripheral region
D peripheral region

The invention claimed is:

1. A cutting knife for machines for cutting up food products, wherein the cutting knife is a sickle knife which rotates about an axis of rotation (11) during a cutting operation and which has a cutting edge (13) at a radially outer periphery of the cutting knife which differs from a circular shape and revolves about the axis of rotation (11) in the manner of a spiral and which is disposed in a cutting plane (15) extending perpendicular to the axis of rotation (11);

wherein the cutting edge (13) forms a radially outwardly disposed end of a blade surface (17) which forms a part of the rear side (21) of the knife remote from a product (19) to be cut up during the cutting operation and includes a blade angle (α) with the cutting plane (15);

wherein a magnitude of the blade angle (α) varies in a peripheral direction; and wherein the blade angle (α) increases constantly over the total cutting edge (13) extending in the peripheral direction.

2. A cutting knife in accordance with claim 1, wherein the cutting knife has an intended direction of rotation (T), with the blade angle (α) increasing against the direction of rotation (T).

3. A cutting knife in accordance with claim 1, wherein the blade angle (α) increases as a radial spacing (R) of the cutting edge (13) from the axis of rotation (11) increases.

4. A cutting knife in accordance with claim 1, wherein the cutting edge (13) has a dipping region (A) with which the cutting knife dips into a product (19) to be cut up on the intended use during the cutting operation, with the blade angle (α) being smaller in the dipping region (A) than in other regions of the cutting knife.

5. A cutting knife in accordance with claim 1, wherein the change in the blade angle (α) takes place without the formation of steps in the blade surface (17).

6. A cutting knife in accordance with claim 1, wherein the blade angle (α) varies in a range from approximately 20° to 30° .

7. A cutting knife in accordance with claim 1, wherein the blade surface (17) has a width (W) which varies in dependence on the size of the blade angle (α).

8. A cutting knife in accordance with claim 1 , wherein the blade surface has a width a (W) that varies in a range from approximately 0.5 mm to 1.5 mm.

9. A cutting knife in accordance with claim 1, wherein the cutting edge (13) extends over an angle which is disposed between 180° and 360°.

10. A cutting knife in accordance with claim 1, wherein a further surface (23) is formed radially within the blade surface (17) and forms a part of a rear side (21) of the knife and includes an angle (β) with the cutting plane (15) which is constant and smaller than the smallest blade angle (α) in the peripheral direction.

11. A cutting knife in accordance with claim 10, wherein the blade surface (17) and the further surface (23) are directly adjacent to one another.

12. A cutting knife in accordance with claim 10, wherein at least one transition surface is formed between the blade surface (17) and the further surface (23).

13. A cutting knife in accordance with claim 1, wherein the blade surface (17) is formed by abrading.

14. A cutting knife in accordance with claim 1, wherein the machine for cutting food products is a high speed slicer.

* * * * *